US006633139B2

(12) United States Patent
Piaskowski

(10) Patent No.: US 6,633,139 B2
(45) Date of Patent: Oct. 14, 2003

(54) CONVERTER FOR CONVERTING AN AC POWER MAIN VOLTAGE TO A VOLTAGE SUITABLE FOR DRIVING A LAMP

(75) Inventor: Andrew D. Piaskowski, St-Lazare (CA)

(73) Assignee: Groupe Delta Xfo, Inc., Quebec (CA)

( * ) Notice: Subject to any disclaimer, the term of this patent is extended or adjusted under 35 U.S.C. 154(b) by 0 days.

(21) Appl. No.: 09/899,769

(22) Filed: Jul. 2, 2001

(65) Prior Publication Data

US 2003/0001517 A1 Jan. 2, 2003

(51) Int. Cl.[7] ..... H05B 37/02
(52) U.S. Cl. ..... 315/224; 315/291; 315/308
(58) Field of Search ..... 315/276, 209 R, 315/224, 225, 119, 307, 291, 308

(56) References Cited

U.S. PATENT DOCUMENTS

| | | | | |
|---|---|---|---|---|
| 4,972,124 A | | 11/1990 | Powers | 315/219 |
| 5,828,188 A | * | 10/1998 | Lecheler | 315/225 |
| 5,883,473 A | * | 3/1999 | Li et al. | 315/209 R |
| 6,049,179 A | * | 4/2000 | Kisaichi et al. | 315/224 |
| 6,157,551 A | | 12/2000 | Barak et al. | 363/37 |
| 6,208,086 B1 | | 3/2001 | Nerone | 315/276 |
| 6,222,322 B1 | * | 4/2001 | Stack | 315/119 |
| 6,262,542 B1 | * | 7/2001 | Kim et al. | 315/209 R |
| 6,331,755 B1 | * | 12/2001 | Ribarich et al. | 315/119 |

FOREIGN PATENT DOCUMENTS

CA 2271446 5/1999

OTHER PUBLICATIONS

Brochure "Electronic Transformers for Halogen Lamps 12V", Fluorel, Edition 2001.
Article: "Electronic Transformer Dims Halogen Lamp", R. Magdziak, *EDN*, May 11, 2001.
STMicroelectronics Application Note Electronic Transformer for a 12V Halogen Lamp, P. Fichera et al., 1999.

* cited by examiner

*Primary Examiner*—Don Wong
*Assistant Examiner*—Ephrem Alemu
(74) *Attorney, Agent, or Firm*—Olson & Hierl, Ltd.

(57) ABSTRACT

An electronic converter converts high-voltage AC power main voltage, such as 120V, 240V or 277V, to a low-voltage suitable for driving a halogen lamp. The converter includes a rectifier circuit, starter circuit, a driver circuit, a current sensing circuit and a transformer circuit. The current sensing circuit senses an output current of the converter. The sensed current is used to govern pulse-width modulation of the lamp drive voltage, to provide over-voltage protection. Temperature protection can also be provided to reduce drive current when the converter overheats. This enables reliable operation of the converter over an extended temperature range, and reduces the occurrence of converter component failures due to ground faults or overheating.

34 Claims, 8 Drawing Sheets

CONVERTER FOR CONVERTING AN AC POWER MAIN VOLTAGE TO A VOLTAGE SUITABLE FOR DRIVING A LAMP

CROSS-REFERENCE TO RELATED APPLICATIONS

This is the first application filed for the present invention.

MICROFICHE APPENDIX

Not Applicable.

TECHNICAL FIELD

The present invention relates to converters for converting alternating current (AC) power main voltage to a voltage suitable for driving a lamp.

BACKGROUND OF THE INVENTION

Most electronic converters for converting AC power main voltage to a voltage for driving a lamp, such as a halogen lamp, are based on self-oscillating technology using bipolar transistors. Since bipolar transistors are current operating devices, obtaining feedback for oscillation is relatively simple. However, bipolar transistor converters suffer from several disadvantages. For example they are subject to secondary breakdown phenomena, increased current leakage and increased power losses at elevated temperatures. The practical limit for junction temperature is 100° C. (case temperature typically 85° C.). Bipolar transistor converters are also expensive for high voltage applications (for example 277V, 240V and 220V). They also are less efficient in operation than field-effect transistors, because a typical limitation on frequency of operation is 35 kHz. Protection against fault conditions is difficult in a simple circuit using bipolar transistors. In addition, size reduction is limited due to operating frequency limitations, and it is difficult to achieve UL Class B temperature classification (135° C. maximum insulation limitation) without a sacrifice in reliability.

U.S. Pat. No. 6,157,551 to Barak, et al., assigned to Lightech Electronic Industries Ltd., which issued Dec. 5, 2000, teaches a power converter using bipolar transistors. However, this converter suffers from the foregoing disadvantages.

U.S. Pat. No. 6,208,086 to Nerone, assigned to General Electric, which issued Mar. 21, 2001, teaches a power converter using N-channel and P-channel field effect transistors (FETs). Nerone achieves size reduction and improves efficiency by operating at higher frequencies (30 kHz–90 kHz). However, Nerone fails to address the issue of high temperature operation and fault protection. Besides, P-channel FETs are expensive compared to N-channel FETs.

There therefore exists a need for a converter that is simple and inexpensive to construct, while providing fault protection and achieving reliable, sustained operation at elevated operating temperatures.

SUMMARY OF THE INVENTION

The present invention provides a converter for converting alternating current (AC) power main voltage to a voltage suitable for driving a lamp. The converter comprises a rectifier circuit connectable to the AC power main, adapted to rectify the AC power main voltage and adapted to provide a direct current (DC) voltage; a driver circuit adapted to receive the DC voltage from the rectifier circuit, and provide a driver output voltage and a driver output current, and further adapted to receive an output current limiting signal; a starter circuit for providing a starter signal that initiates oscillation at an operating frequency in the driver circuit; a sensing circuit for sensing the driver output current and providing the output current limiting signal in response to the sensed driver output current; and a transformer for transforming the driver output voltage to a voltage suitable for driving a lamp such as a halogen lamp.

The sensing circuit may be further adapted to provide overheating protection for the converter. Overheating protection can be provisioned in a plurality of ways. In one embodiment, the sensing circuit includes a Negative Temperature Coefficient (NTC) thermistor that is in good thermal contact with the converter. A resistance of the NTC thermistor is reduced as a temperature of the converter rises. This causes the output current limiting signal to reduce output current from the driver circuit when the converter overheats. The reduction in driver output current permits the converter to cool and inhibits component failure. In another embodiment, a silicon diode is used rather than a NIC thermistor. A switching threshold of the silicon diode is reduced as a temperature of the converter rises. This causes the output current limiting signal to reduce output current from the driver circuit to halt the rise in temperature.

In accordance with another aspect of the invention, a method is provided for controlling an output voltage of a driver circuit in response to an output current of a converter for converting an AC (alternating current) power main voltage to a voltage suitable for driving a lamp. The method comprises the steps of sensing the converter output current; testing whether the sensed converter output current exceeds a threshold; sensing the extent to which the converter output current exceeds the threshold; triggering a latch when the sensed converter output current exceeds the threshold and stopping an oscillation of the driver circuit; re-setting the latch after a period of time related to an extent to which the converter output current exceeds the threshold, and re-starting the oscillation of the driver circuit.

Advantages of the invention include power savings, extended service life for converter components, reduced power loss, and reduced heat generation.

A further advantage of the invention is an avoidance of high cost electrolytic or tantalum capacitors, and improved reliability at high temperature operation.

Another advantage of the invention is a protection against fault conditions, such as output short circuits.

A further advantage of the invention is an extended operational temperature range for the converter, which enables the converter to achieve an Underwriters Laboratories (UL) Class B temperature classification up to 135° C., which is a maximum insulation limitation.

Yet another advantage of the invention is providing a converter with an operating frequency that is greater than 43 kHz, which enables smaller converter packages and more power efficient converters.

Still another advantage of the invention relates to decreased current leakage and switching losses at elevated temperature resulting from the use of field-effect transistors for switching drive current.

The invention also provides a converter, that is reliable, versatile, compact and efficient, with a reduced parts count.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
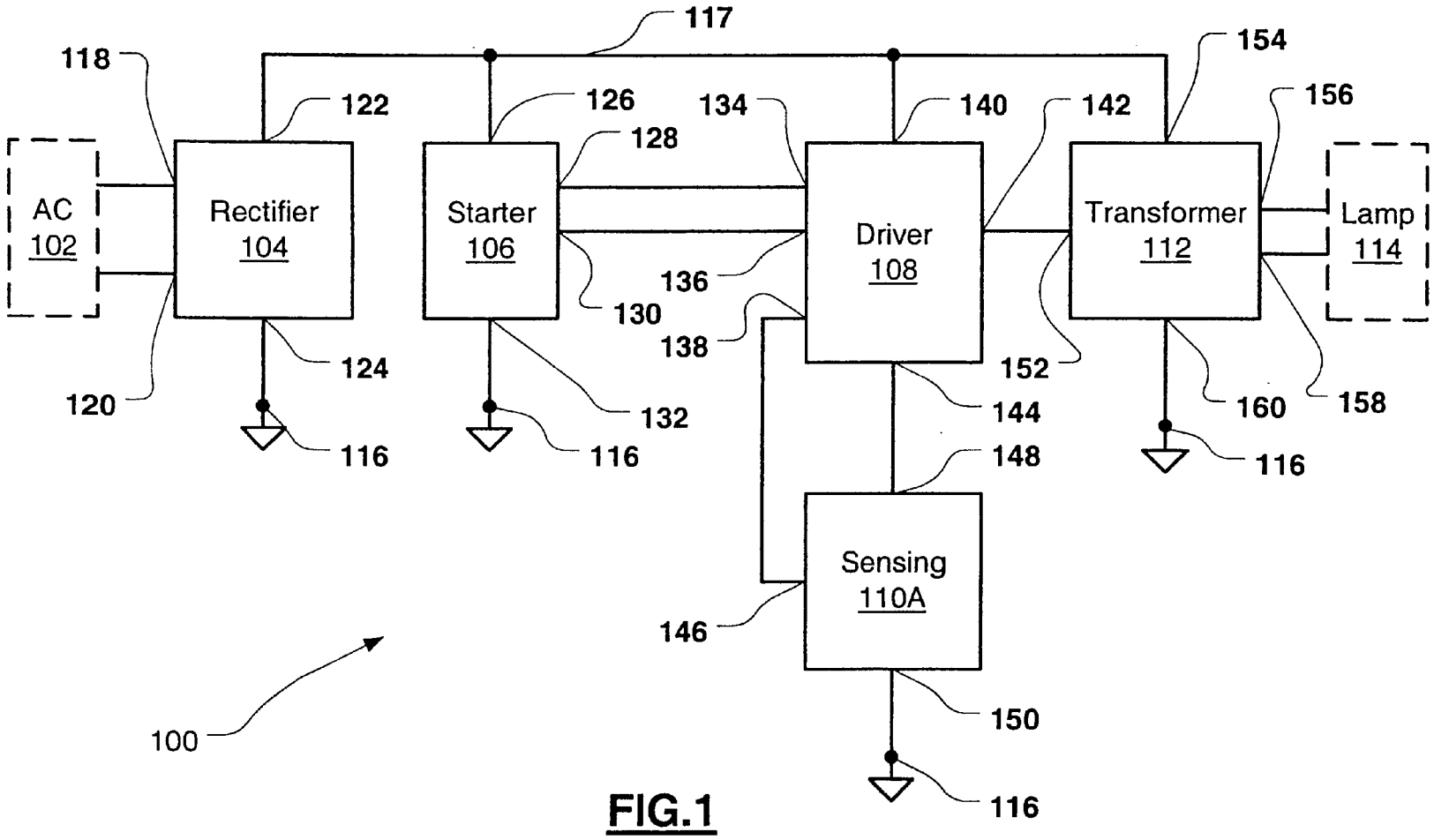
FIG. 1 is a block diagram of converter in accordance with the present invention.

FIG. 1 illustrates a converter 100 in accordance with the invention. The converter 100 includes a rectifier circuit 104, a starter circuit 106, a driver circuit 108, a sensing circuit 110A, and a transformer circuit 112. The rectifier circuit 104 has a first and second input 118,120 connectable to an AC (alternating current) power main 102 (shown in dotted outline), a first terminal 122 connected to a power supply node 117 and a second terminal 124 connected to a ground reference node 116. The starter circuit 106 has a first terminal 126 connected to power supply node 117, a second terminal 132 connected to ground reference node 116, a clamp 128 and an output 130. The driver circuit 108 has a first output 134 connected to the clamp 128 of starter circuit 106, a first input 136 connected to output 130 of starter circuit 106, a second input 138, a first terminal 140 connected to the power supply node 117, a second output 142 and a second terminal 144. The sensing circuit 110A has an output 146 connected to the second input 138 of the driver circuit 108, a first terminal 148 connected to the second terminal 144 of the driver circuit 108 and a second terminal 150 connected to ground reference node 116. The transformer circuit 112 has an input 152 connected to the second output 142 of the driver circuit 108, a first terminal 154 connected to the power supply node 117, a second terminal 160 connected to ground reference node 116 and a first and second output 156,158 connectable to a lamp 114 (shown in dotted outline).

Figure 2:
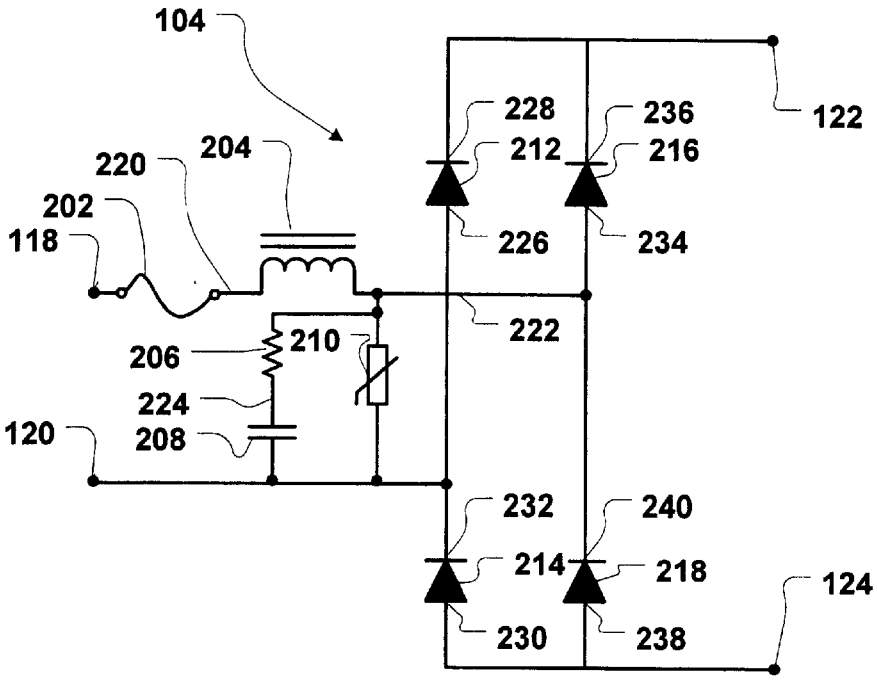
FIG.2 PRIOR ART
FIG. 2 is a schematic diagram of an exemplary rectifier circuit for use in the converter shown in FIG. 1.

FIG. 2 illustrates a conventional embodiment of the rectifier circuit 104. The rectifier circuit 104 includes a fuse 202, an inductor 204, a resistor 206, a capacitor 208, a metal oxide varistor (MOV) 210, a first diode 212, a second diode 214, a third diode 216 and a fourth diode 218. The fuse 202 is connected between the first input 118 of the rectifier circuit 104 and a first node 220. Inductor 204 is connected between the first node 220 and a second node 222. The resistor 206 is connected between the second node 222 and a third node 224. The capacitor is 208 is connected between the third node 224 and the second input 120 of the rectifier circuit 104. The MOV 210 is connected between the second node 222 and the second input 120 of the rectifier circuit 104. The first diode 212 has an anode 226 connected to the second input 120 of the rectifier circuit 104 and a cathode 228 connected to the first terminal 122 of the rectifier circuit 104. The second diode 214 has an anode 230 connected to the second terminal 124 of the rectifier circuit 104 and a cathode 232 connected to the second input 120 of the rectifier circuit 104. The third diode 216 has an anode 234 connected to the second node 222 and a cathode 236 connected to the first terminal 122 of the rectifier circuit 104. The fourth diode 218 has an anode 238 connected to the second terminal 124 of the rectifier circuit 104 and a cathode 240 connected to the second node 222.

Figure 3:
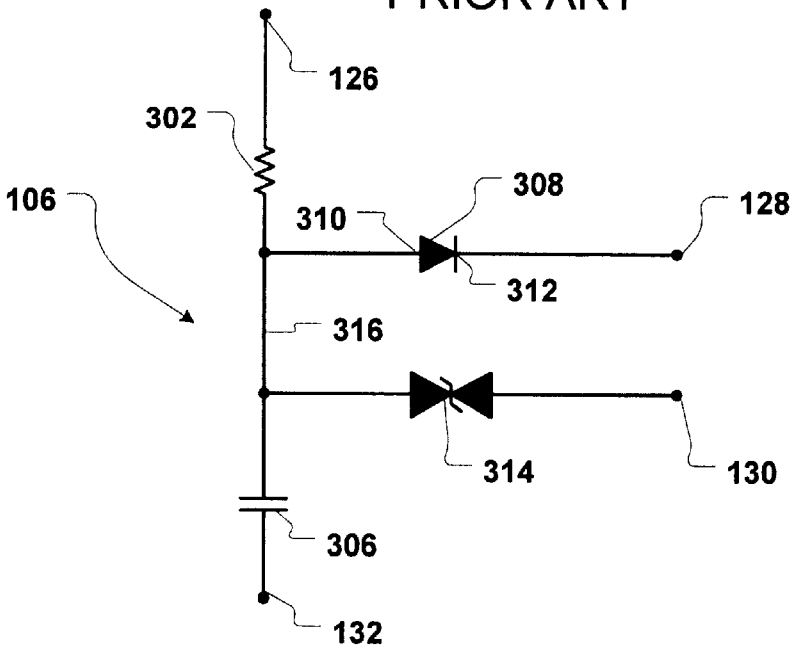
FIG.3 PRIOR ART
FIG. 3 is a schematic diagram of an exemplary starter circuit for use in the converter shown in FIG. 1.

FIG. 3 illustrates a conventional embodiment of the starter circuit 106 that includes a resistor 302, a capacitor 306, a diode 308 and a diac 314. The resistor 302 is connected between the first terminal 126 of the starter circuit 106 and a node 316. The capacitor 306 is connected from the node 316 to the second terminal 132 of the starter circuit 106. The diode 308 has an anode 310 connected to the node 316 and a cathode 312 connected to the clamp 128 of the starter circuit 106. The diac 314 is connected between the node 316 and the output 130 of the starter circuit 106.

Figure 4:
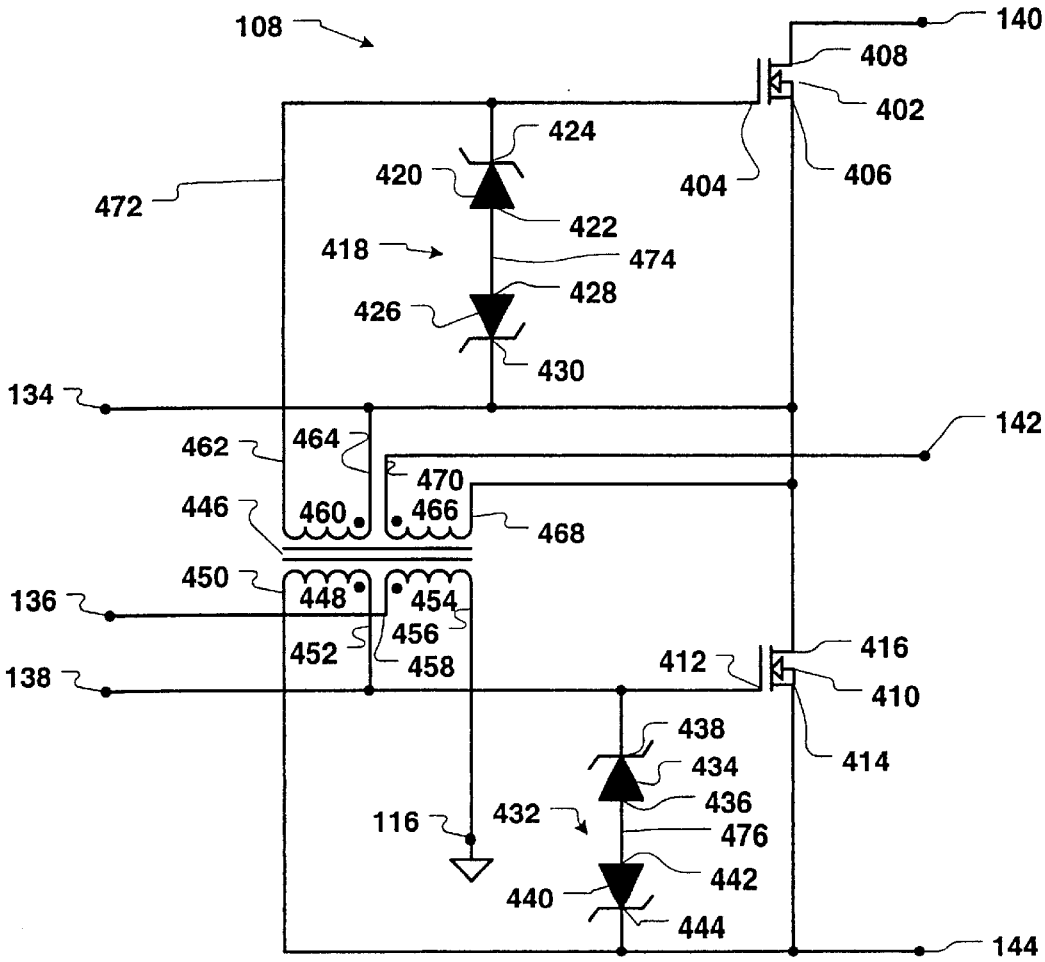
FIG. 4 is a schematic diagram of an exemplary driver circuit for use in the converter shown in FIG. 1.

FIG. 4 illustrates a preferred embodiment of the driver circuit 108, which includes a high-side switch, preferably a first N-channel FET (field effect transistor) 402, a low-side switch, preferably a second N-channel FET 410, a first bi-directional voltage clamping circuit 418, a second bi-directional voltage clamping circuit 432 and a feedback transformer 446.

The first N-channel FET 402 has a gate 404 connected to a first node 472, a source 406 connected to the first output 134 of the driver circuit 108 and a drain 408 connected to the first terminal 140 of the driver circuit 108. The second N-channel FET 410 has a gate 412 connected to the second input 138, a source 414 connected to the second terminal 144 of the driver circuit 108 and a drain 416 connected to the first output 134 of the driver circuit 108.

The first bi-directional voltage clamping circuit 418 includes a first zener diode 420 having an anode 422 connected to a second node 474 and a cathode 424 connected to the first node 472; and a second zener diode 426 having an anode 428 connected to the second node 474 and a cathode 430 connected to the first output 134 of the driver circuit 108. The second bi-directional voltage clamping circuit 432 includes a third zener diode 434 having an anode 436 connected to a third node 476 and a cathode 438 connected to the second input 138 of the driver circuit 108; and a fourth zener diode 440 having an anode 442 connected to the third node 476 and a cathode 444 connected to the second terminal 144 of the driver circuit 108.

The feedback transformer 446 includes a first winding 448 having a first terminal 450 and a second terminal 452, a second winding 454 having a first terminal 456 and a second terminal 458, a third winding 460 having a first terminal 462 and a second terminal 464, and a fourth winding 466 having a first terminal 468 and a second terminal 470. The first terminal 450 of the first winding 448 is connected to the second terminal 144 of the driver circuit 108. The second terminal 452 of the first winding 448 is connected to the second input 138 of the driver circuit 108. The first terminal 456 of the second winding 454 is connected to the ground reference node 116. The second terminal 458 of the second winding 454 is connected to the first input 136 of the driver circuit 108. The first terminal 462 of the third winding 460 is connected to the first node 472. The second terminal 464 of the third winding 460 is connected to the first output 134 of the driver circuit 108. The first terminal 468 of the fourth winding 466 is connected to the first output 134 of the driver circuit 108. The second terminal 470 of the fourth winding 466 is connected to the second output 142 of the driver circuit 108.

The first winding 448, the second winding 454, the third winding 460 and the fourth winding 466 of the feedback transformer 446 are arranged so that current flowing into the first terminal 450 of the first winding 448 causes current to flow out of the first terminal 456 of the second winding 454, the first terminal 462 of the third winding 460 and the first terminal 468 of the fourth winding 466.

Figure 5A:
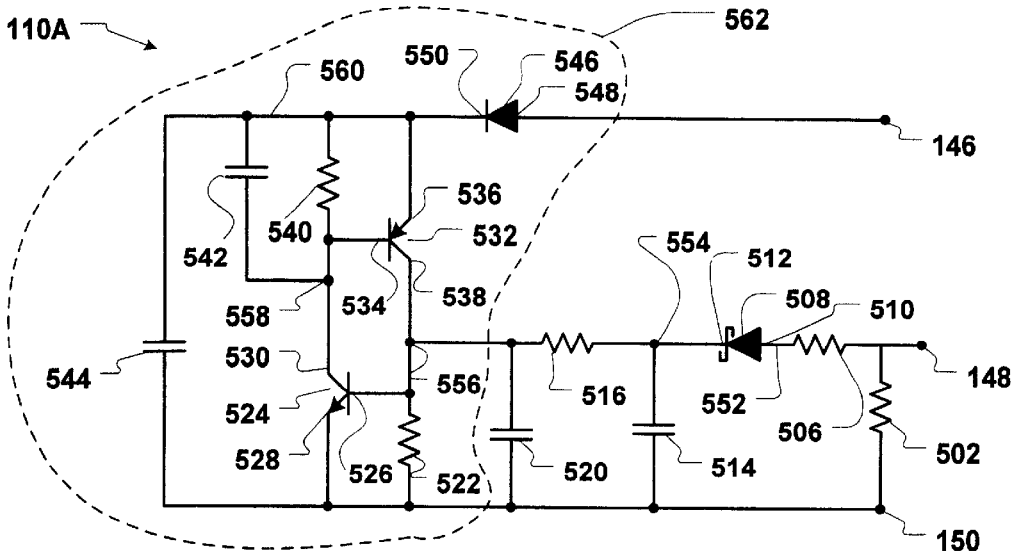
FIG. 5A is a schematic diagram of an exemplary sensing circuit for use in the converter shown in FIG. 1.

FIG. 5A illustrates a preferred embodiment of the sensing circuit 110A, which includes a first resistor 502, a second resistor 506, a first diode 508 which is preferably a schottky diode, a first capacitor 514, a third resistor 516, a second capacitor 520, a fourth resistor 522, an NPN transistor 524, a PNP transistor 532, a fifth resistor 540, a third capacitor 542, a fourth capacitor 544 and a second diode 546.

The first resistor 502 is connected between the first terminal 148 of the sensing circuit 110A and the second terminal 150 of the sensing circuit 110A. The second resistor 506 is connected between the first terminal 148 of the sensing circuit 110A and a first node 552. The first diode 508 has an anode 510 connected to the first node 552 and a cathode 512 that is connected to a second node 554. The first capacitor 514 is connected between the second node 554 and the second terminal 150 of the sensing circuit 110A. The third resistor 516 is connected between the second node 554 and a third node 556. The second capacitor 520 is connected between the third node 556 and the second terminal 150 of the sensing circuit 110A. The fourth resistor 522 is connected between the third node 556 and the second terminal 150 of the sensing circuit 110A. The NPN transistor 524 has a base 526 connected to the third node 556, an emitter 528 connected to the second terminal 150 of the sensing circuit 110A and a collector 530 connected to a fourth node 558. The PNP transistor 532 has a base 534 connected to the fourth node 558, an emitter 536 connected to a fifth node 560 and a collector 538 connected to the third node 556. The fifth resistor 540 is connected between the fourth node 558 and the fifth node 560. The third capacitor 542 is connected between the fourth node 558 and the fifth node 560. The fourth capacitor 544 is connected between the fifth node 560 and the second terminal 150 of the sensing circuit 110A. The second diode 546 has an anode 548 connected to the output 146 of the sensing circuit 110A and a cathode 550 connected to the fifth node 560. For convenience, a portion of sensing circuit 110A that includes the fourth resistor 522, the NPN transistor 524, the PNP transistor 532, the fifth resistor 540, the third capacitor 542, the fourth capacitor 544 and the second diode 546 is hereinafter referred to as a latch 562.

Figure 5B:
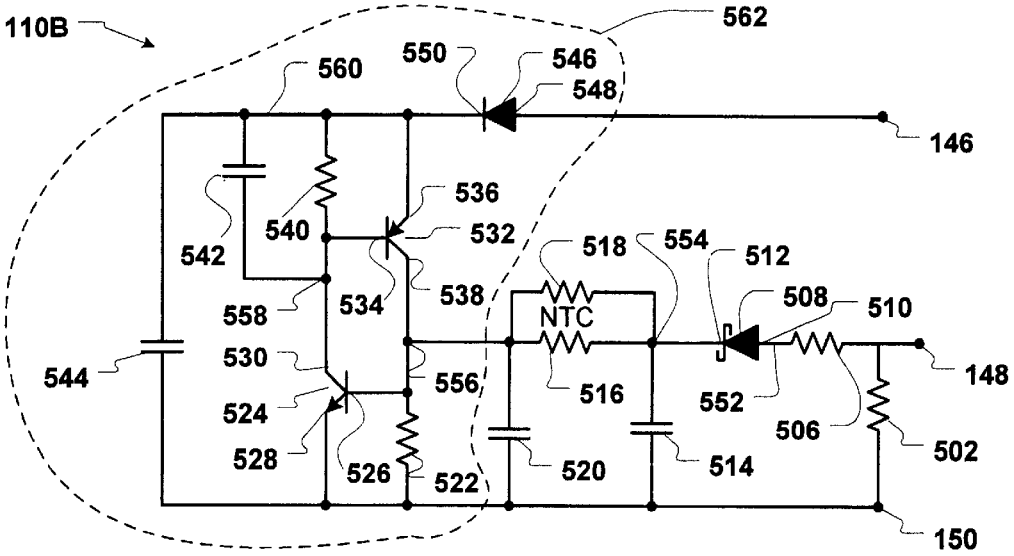
FIG. 5B is a schematic diagram of an exemplary sensing circuit for use in the converter shown in FIG. 1.

FIG. 5B illustrates an alternate embodiment of a sensing circuit 110B. The sensing circuit 110B is identical to the sensing circuit 110A except that a negative temperature coefficient (NTC) thermistor 518 has been added in parallel with third resistor 516. The NTC thermistor 518 provides thermal protection for the converter 100, as will be explained below in detail.

Figure 5C:
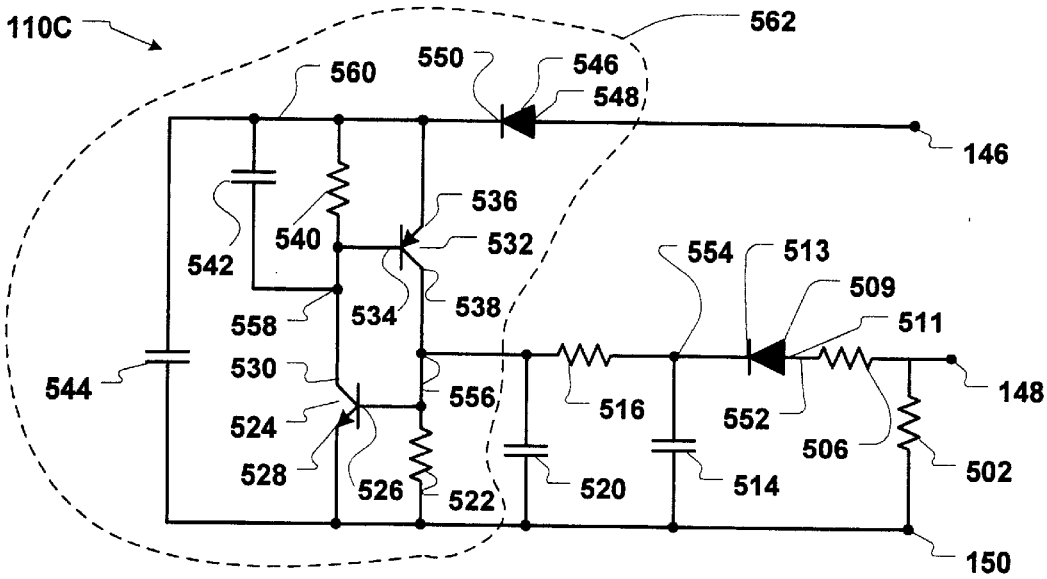
FIG. 5C is a schematic diagram of an exemplary sensing circuit for use in the converter shown in FIG. 1.

FIG. 5C shows another alternate embodiment of a sensing circuit 110C. The sensing circuit 110C is identical to the sensing circuit 110A except that the first diode 508 has been replaced with a silicon diode 509 having an anode 511 connected to first node 552 and a cathode 513 connected to second node 554. The silicon diode 509 also provides thermal protection for the converter 100, as will likewise be explained below in detail.

Figure 6:
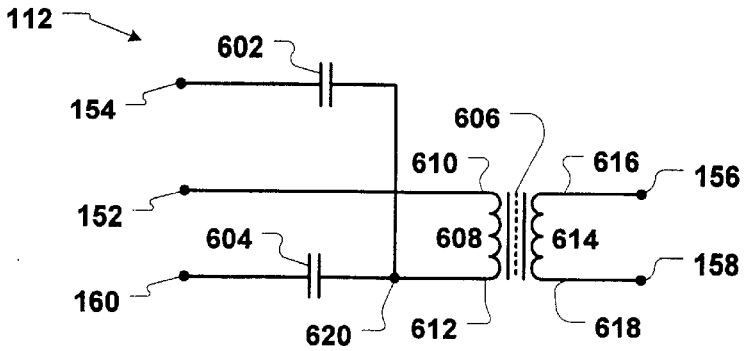
FIG.6 PRIOR ART
FIG. 6 is a schematic diagram of an exemplary transformer circuit for use in the converter shown in FIG. 1.

FIG. 6 shows a conventional embodiment of the transformer circuit 112 that includes a first capacitor 602, a second capacitor 604, and a transformer 606. The first capacitor 602 is connected between the first terminal 154 of the transformer circuit 112 and a node 620. The second capacitor 604 is connected between the node 620 and the second terminal 160 of the transformer circuit 112. The transformer 606 has a first winding 608 having a first terminal 610 and a second terminal 612; and a second winding 614 having a first terminal 616 and a second terminal 618. The first terminal 610 of the first winding 608 is connected to the input 152 of the transformer circuit 112. The second terminal 612 of the first winding 608 is connected to the node 620. The first terminal 616 of the second winding 614 is connected to the first output 156 of the transformer circuit 112. The second terminal 618 of the second winding 614 is connected to the second output 158 of the transformer circuit 112.

Figure 7:
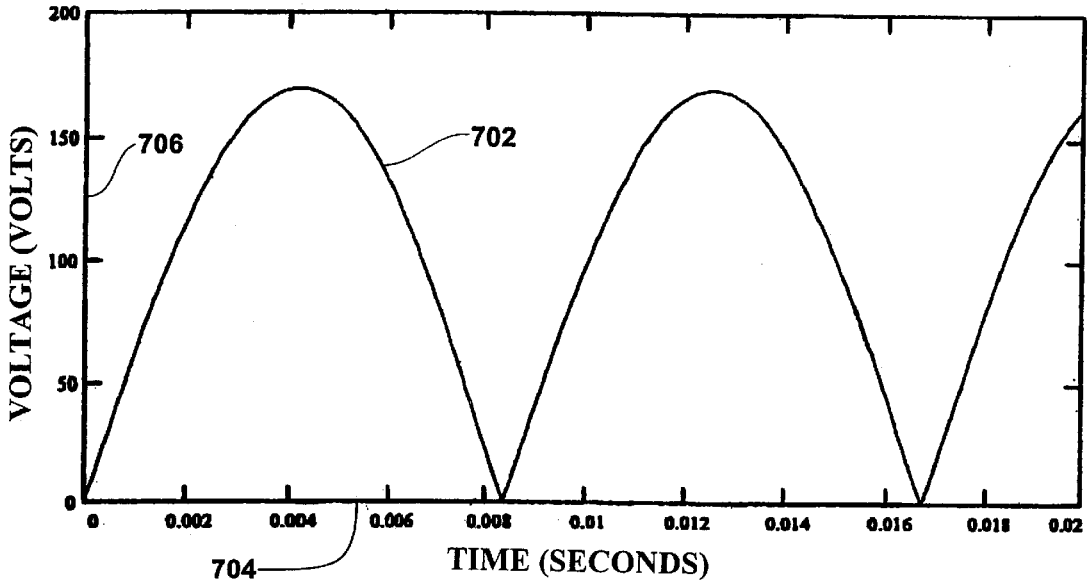
FIG.7 PRIOR ART
FIG. 7 is a plot of an output voltage of the rectifier circuit shown in FIG. 2, versus time.

In operation, the rectifier circuit 104 (FIG. 1) receives a 60 Hz, 120V power main voltage applied to first and second inputs 118,120 and outputs a semi-sinusoidal voltage 702 at 120 Hz, as shown in FIG. 7. In FIG. 7, the x-axis 704 represents time (seconds) and the y-axis 706 represents voltage (Volts). The operation of the rectifier circuit 104 is understood by those skilled in the art.

Oscillation of the driver circuit 108 starts each cycle when the voltage applied to the node 316 in the starter circuit 106 rises sufficiently to turn on the diac 314. When the diac 314 turns on, a pulse of current is provided to the second winding 454 of the feedback transformer 446. The pulse of current is coupled through the third winding 460 to the gate 404 of the first N-channel FET 402 and through the second winding 454 to the gate 412 of the second N-channel FET 410. The direction of the third winding 460 and the second winding 454 are selected so that the pulse of current from the starter circuit 106 will turn off the first N-channel FET 402 and turn on the second N-channel FET 410. This causes the voltage on the first output 134 of the driver circuit 108 to fall. If a load, such as a lamp 114, is connected to the first and second outputs 156,158 of the transformer circuit 112, then a driver output current will flow through the fourth winding 466. The direction of the fourth winding 466 is selected so that a positive feedback is supplied to the gate 404 of the first N-channel FET 402 and the gate 412 of the second N-channel FET 410. The voltage of the first output 134 of the driver circuit 108 falls to the voltage of the ground reference node 116. After a period of time determined by the size and the maximum flux density of the core used in the feedback transformer 446, the feedback to the gate 404 of the first N-channel FET 402 and the gate 412 of the second N-channel FET 410 is removed. The voltage of the first output 134 of the driver circuit 108 starts to rise, creating a positive feedback that turns on the first N-channel FET 402 and turns off the second N-channel FET 410. The voltage of the first output 134 of the driver circuit 108 rises to the voltage of the power supply node 117. Again, after a period of time determined by the size and the maximum flux density of the core used in feedback transformer 446, the feedback to the gate 404 of the first N-channel FET 402 and the gate 412 of the second N-channel FET 410 is removed. The voltage of the first output 134 of the driver circuit 108 then starts to fall, creating positive feedback that turns off the first N-channel FET 404 and turns on the second N-channel FET 410. Thus, oscillation is established at an operating frequency in the driver circuit 108. If no load is present, there is no positive feedback and no oscillation occurs.

Once oscillation has been established, the diode 312 of the starter circuit 106 (FIG. 3) maintains a voltage of the node 316 of the starter circuit 106 at a value that is less than a conduction threshold voltage of the diac 314.

Figure 8:
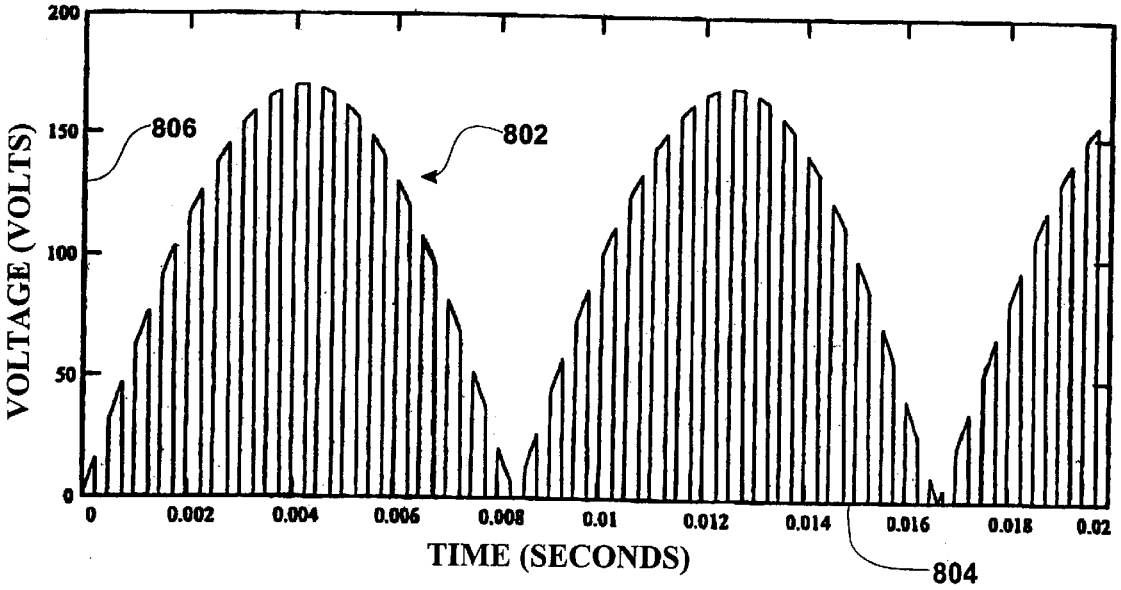
FIG. 8 is a plot of an output voltage of the driver circuit shown in FIG. 4, versus time.
Figure 9:
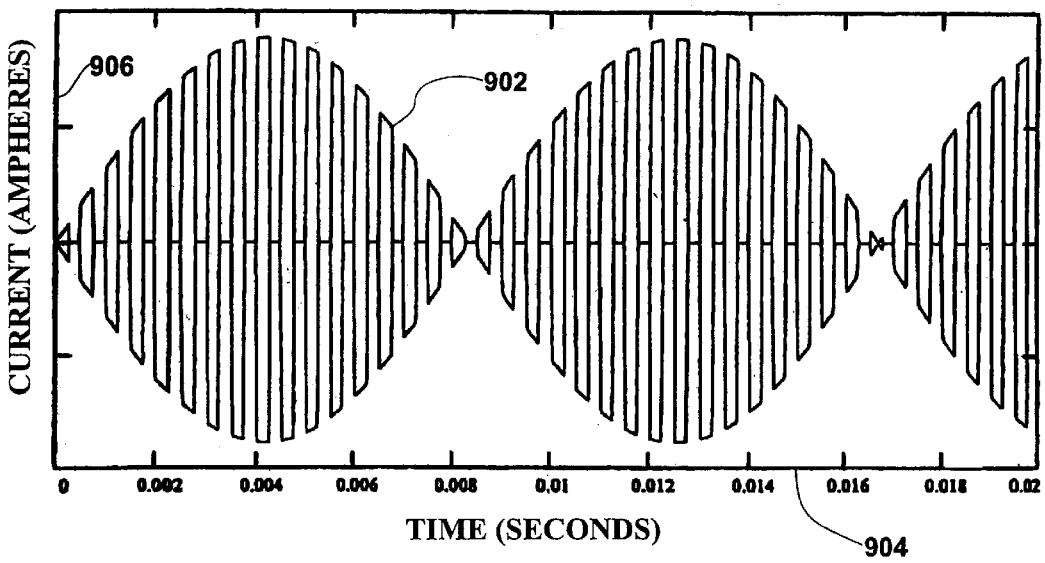
FIG. 9 is a plot of an output current of the transformer circuit shown in FIG. 6, versus time.
Figure 10:
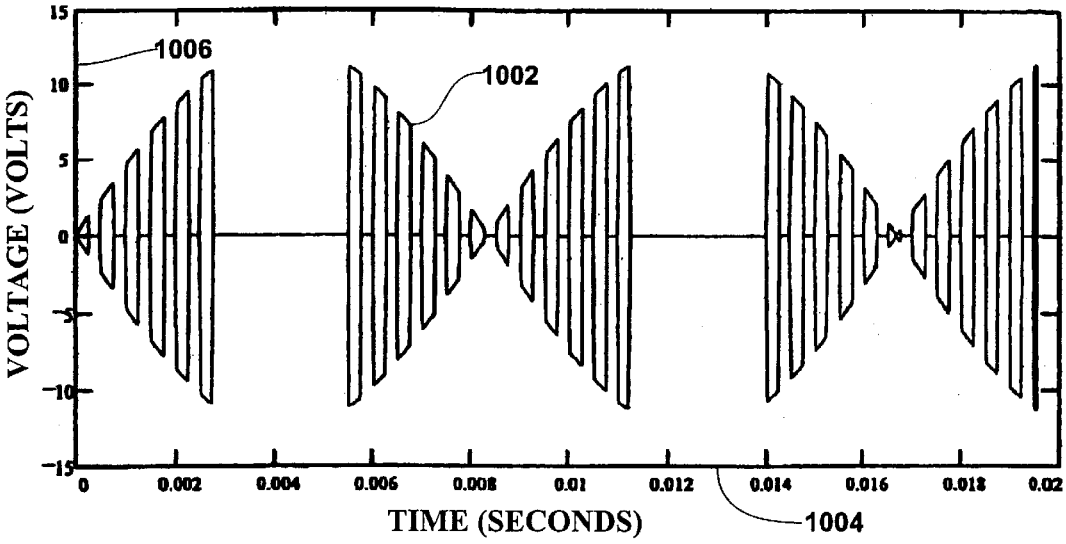
FIG. 10 is a plot of an output voltage of the transformer circuit shown in FIG. 6, versus time.

Voltage waveform 802 of the first output 134 of the driver circuit 108 is shown in FIG. 8, in which the x-axis 804 represents time (seconds) and the y-axis 806 represents voltage (Volts). The resulting current waveform 902 in the lamp 114 is shown in FIG. 9, wherein the x-axis 904 represents time (seconds) and the y-axis 906 represents current (Amperes). It should be noted that the operating frequency illustrated in FIGS. 8, 9 and 10 is much lower than the normal operating frequency for purposes of clarity, and that normal operating frequency is preferably greater than 43 kHz.

The converter 100 provides current overload protection. When a current overload condition occurs, such as a short circuit between the first and second outputs 156,158 of transformer circuit 112 causing the output current of driver circuit 106 to rise above a predetermined threshold, a voltage across the first resistor 502 of the sensing circuit 110A (FIG. 5A) is large enough to turn on the first diode 508 of the sensing circuit 110A. The first capacitor 514 and the second capacitor 520 are charged so that latch 562 is triggered. The triggering of latch 562 causes current to be drawn into the output 146 of the sensing circuit 110A and to reduce voltage on the gate 412 of the second N-channel FET 410 and the gate 404 of the first N-channel FET 402 by mutual coupling (FIG. 4). This turns off the second N-channel FET 410 causing the voltage on the first terminal 148 of the sensing circuit 110A to decrease, oscillation of the driver circuit 106 to stop and turn off the first diode 508 of the sensing circuit 110A. After a period of time determined by values of the first capacitor 514, the third resistor 516, the second capacitor 520, the fourth resistor 522, the fifth resistor 540, the third capacitor 542, the fourth capacitor 544, and the extent to which the output current of the driver circuit 106 exceeded the predetermined threshold, the latch 562 re-sets to permit oscillation of driver circuit 106 to re-start. The resulting waveform 1002 of the voltage across the lamp 114 is shown in FIG. 10, wherein the x-axis 1004 represents time (seconds) and the y-axis 1006 represents voltage (Volts). The voltage across the lamp 114 is thus pulse-width modulated by the current limiting signal on the output 146 of the sensing circuit 110A.

The alternate embodiment shown in FIG. 5B introduces the NTC thermistor 518 to provide temperature protection for the converter 100. The NTC thermistor 518 is placed in good thermal contact with converter 100. As the temperature of the converter 100 rises, the impedance of the NTC thermistor 518 is reduced. This has the effect of reducing the predetermined threshold for the current overload condition described above. Consequently, as the temperature of the converter 100 increases beyond a threshold determined by resistance characteristics of the NTC thermistor 518, the driver output current provided to the lamp 114 is reduced, permitting the converter 100 to cool. As cooling occurs, the driver output current is increased. The cycle automatically repeats, as required.

In the alternate embodiment shown in FIG. 5C, the silicon diode 509 serves the same function as the NTC thermistor 518. The silicon diode 509 is placed in good thermal contact with the converter 100. As the temperature of the converter 100 rises, the switching threshold of the silicon diode 509 is reduced. This also has the effect of reducing the predetermined threshold of the current limiting circuit described above, to provide thermal protection as described with reference to FIG. 5B.

Figure 11:
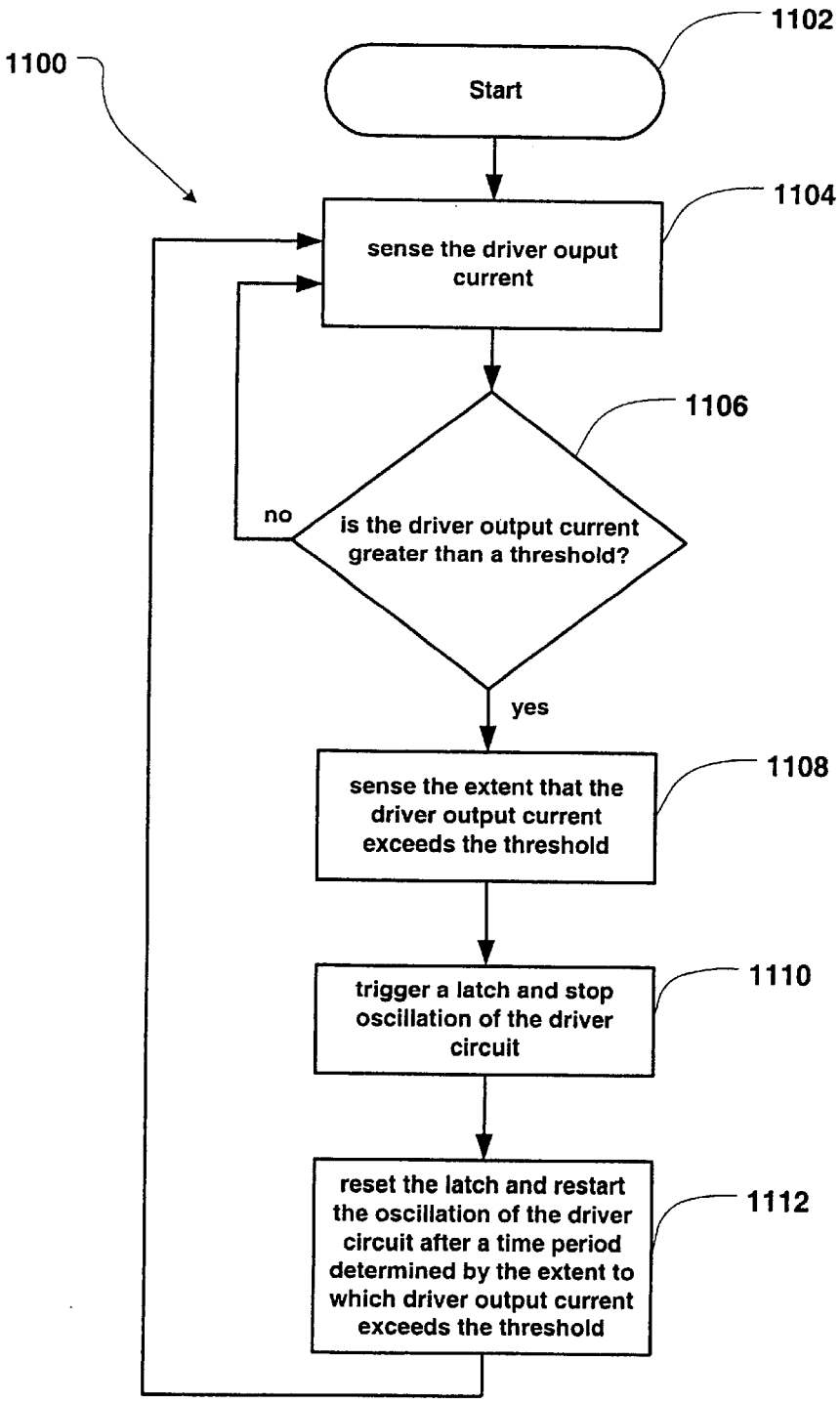
FIG. 11 is a flowchart of a method of controlling pulse-width modulation in a converter in accordance with the present invention.

The present invention also provides a method for controlling an output voltage of the driver circuit 106 to provide current limiting protection for the converter 100. FIG. 11 is a flowchart 1100 illustrating the method. The method starts (step 1102) when power is supplied to the AC inputs 118,120 of the rectifier 104. The driver output current is sensed (step 1104) by the sensing current 110A, 110B or 110C to determine whether the sensed driver output current exceeds a threshold (step 1106) determined by the component values of the components of the sensing circuit 110A, as described above. If the driver current is not greater than the threshold, the sensing of the driver output current continues (step 1104). If, however, the sensed driver output current exceeds the threshold, then the extent to which the driver output current exceeds the threshold is sensed (step 1108). The latch 562 is triggered when the sensed driver output current exceeds the threshold. This stops an oscillation of the driver circuit (step 1110). The latch 562 is re-set after a period of time related to an extent to which the driver output current exceeded the threshold (step 1112) Meanwhile, the sensing circuit 110A continues to sense the driver output current (step 1102).

As explained above, if the NTC thermistor 508 (FIG. 5B) or the silicon diode 509 (FIG. 5C) are added to the sensing circuit 110, the converter 100 is further provided with temperature protection, which permits the converter 100 to continue to operate at elevated temperatures without component damage. Experimentation has shown that the converter 100 in accordance with the invention can be operated for extended periods of time at case temperatures of at least 110° C., provided that the sensing circuit 110 is constructed as shown in FIG. 5B or 5C.

The invention therefore provides a simple, high-frequency, light-weight, compact converter 100 that is inexpensive to construct and more robust than converters known from the prior art. The high operating frequency permits all capacitors: 306 shown in FIG. 3, 514,520,542,544 shown in FIGS. 5A–C, and 602,604 shown in FIG. 6, to be solid-state non-polarized capacitors, thereby reducing the weight and package size of the converter 100.

The embodiment(s) of the invention described above is (are) intended to be exemplary only. The scope of the invention is therefore intended to be limited solely by the scope of the appended claims.

I claim:

1. A converter for converting an AC (alternating current) power main voltage to a voltage suitable for driving a lamp, the converter comprising:

a rectifier circuit connectable to the AC power main, adapted to rectify the AC power main voltage and adapted to provide a DC (direct current) voltage;

a driver circuit adapted to receive the DC voltage from the rectifier circuit, and provide a driver output voltage and a driver output current and further adapted to receive an output current limiting signal;

a starter circuit for providing a starter signal that initiates oscillation at an operating frequency in the driver circuit;

a sensing circuit for sensing an output current of the driver circuit and providing the output current limiting signal in response to the sensed output current of the driver circuit; and a transformer circuit for transforming the driver output voltage to a voltage suitable for driving the lamp.

2. The converter as claimed in claim 1 wherein the driver circuit is adapted to modulate the driver output voltage using the output current limiting signal.

3. The converter as claimed in claim 2 wherein the driver circuit is further adapted to pulse-width modulate the driver output voltage using the output current limiting signal.

4. The converter as claimed in claim 1 wherein the lamp is a halogen lamp.

5. The converter as claimed in claim 1 wherein the rectifier circuit is a full-wave bridge rectifier circuit.

6. The converter as claimed in claim 1 wherein the operating frequency is greater than about 43 kHz.

7.The converter as claimed in claim 1 wherein the driver circuit comprises a high-side switch, a low-side switch and a feedback transformer having a first winding for providing feedback to the low-side switch, a second winding for receiving the starter signal from the starter circuit, a third winding for providing feedback to the high-side switch and a fourth winding for receiving the driver output voltage.

8. The converter as claimed in claim 7 wherein the high-side switch has a control terminal, a first terminal and a second terminal; the low-side switch has a control terminal, a first terminal and a second terminal; the first, second, third and fourth windings of the feedback transformer respectively have a first terminal and a second terminal; and, the first terminal of the first winding is connected a second terminal of the driver circuit, the second terminal of the first winding is connected to a second input of the driver circuit, the first terminal of the second winding is connected to a ground reference node, the second terminal of the second winding is connected to a first input of the driver circuit, the first terminal of the third winding is connected to the control terminal of the high-side switch, the second terminal of the third winding is connected to a first output of the driver circuit, the first terminal of the fourth winding is connected to the first output of the driver circuit, the second terminal of the fourth winding is connected to a second output of the driver circuit, the first terminal of the high-side switch is connected to first terminal of the driver circuit, the second terminal of the high-side switch is connected to the first output of the driver circuit, the first terminal of the low-side switch is connected to the first output of the driver circuit and the second terminal of the low-side switch is connected to the second terminal of the driver circuit.

9. The converter as claimed in claim 8 wherein the first, second, third and fourth windings of the feedback transformer are arranged such that current flowing into the first terminal of the first winding causes current to flow out of the first terminal of the second, third and fourth windings.

10. The converter as claimed in claim 7 wherein the high-side and low-side switches are N-channel field-effect transistors.

11. The converter as claimed in claim 9 further comprising a first bi-directional voltage clamping circuit connected between the control terminal and second terminal of the high-side switch and a second bi-directional voltage clamping circuit connected between the control terminal and second terminal of the low-side switch.

12. The converter as claimed in claim 1 wherein the starter circuit comprises:

a resistor connected between a positive supply node and a charging node;

a capacitor connected between the charging node and a ground reference node;

a diode having an anode connected to the charging node and a cathode connected to an input of the starter circuit; and a diac connected between the charging node and an output of the starter circuit.

13. The converter as claimed in claim 12 wherein the capacitor is a solid-state non-polarized capacitor.

14. The converter as claimed in claim 1 wherein the sensing circuit comprises:

an impedance for sensing the driver output current; and a latch adapted to be triggered when the sensed driver output current exceeds a predetermined threshold and to re-set after a predetermined time interval; and further adapted to provide the output current limiting signal.

15. The converter as claimed in claim 14 wherein the sensing circuit further comprises a temperature dependent impedance for sensing a temperature of the converter.

16. The converter as claimed in claim 15 wherein the predetermined threshold is modified in response to a change in the sensed temperature of the converter.

17. The converter as claimed in claim 14 wherein the output current limiting signal governs pulse-width modulation of the driver output voltage by the driver circuit.

18. The converter as claimed in claim 15 wherein the temperature dependent impedance is a negative temperature coefficient thermistor.

19. The converter as claimed in claim 15 wherein the temperature dependent impedance is a silicon diode.

20. The converter as claimed in claim 1 wherein the sensing circuit comprises a first resistor connected between an input of the sensing circuit and a ground reference node; a second resistor connected between the input of the sensing circuit and a first node; a first diode having an anode connected to the first node and a cathode connected to a second node; a first capacitor connected between the second node and the ground reference node; a third resistor connected between the second node and a third node; a second capacitor connected between the third node and the ground reference node; a fourth resistor connected between the third node and the ground reference node; an NPN transistor having a base connected to the third node, an emitter connected to the ground reference node and a collector connected to a fourth node; a PNP transistor having a collector connected to the third node, a base connected to the fourth node and an emitter connected to a fifth node; a fifth resistor connected between the fourth node and the fifth node; a third capacitor connected between the fourth node and fifth node; a fourth capacitor connected between the fifth node and the ground reference node; and a second diode having an anode connected to an output of the sensing circuit and a cathode connected to the fifth node.

21. The converter as claimed in claim 20 wherein the first, second, third and fourth capacitors are solid-state non-polarized capacitors.

22. The converter as claimed in claim 20 wherein the first diode is a schottky diode.

23. The converter as claimed in claim 20 wherein the first diode is a silicon diode.

24. The converter as claimed in claim 20 further comprising a thermistor connected between the second node and the third node.

25. The converter as claimed in claim 15 wherein the sensing circuit is further adapted to sense the driver output current and to provide the output current limiting signal according to the driver output current and the temperature of the converter.

26. The converter as claimed in claim 25 wherein the output current limiting signal governs pulse-width modulation of the driver output voltage by the driver circuit.

27. A method for controlling an output voltage of a driver circuit in response to an output current of a converter for converting an AC (alternating current) power main voltage to a voltage suitable for driving a lamp, the method comprising the steps of:

sensing the converter output current to determine whether the sensed converter output current exceeds a threshold;

if the threshold is exceeded, sensing an extent to which the converter output current exceeds the threshold;

triggering a latch when the sensed converter output current exceeds the threshold to stop an oscillation of the driver circuit;

re-setting the latch after a period of time related to an extent to which the converter output current exceeded the threshold to permit the oscillation of the driver circuit to be re-started.

28. The method as claimed in claim 27 further comprising a step of using an output voltage of the converter to drive a halogen lamp.

29. The method as claimed in claim 27 wherein the step of sensing further comprises a step using a temperature dependent impedance to perform the output current sensing.

30. The method as claimed in claim 29 further comprising a step of sensing a temperature of the converter.

31. The method as claimed in claim 30 further comprising a step of reducing the predetermined threshold in response to the sensed temperature of the converter.

32. The method as claimed in claim 29 wherein the step of sensing the temperature further comprises a step of using a thermistor to sense the temperature.

33. The method as claimed in claim 29 wherein the step of sensing the temperature further comprises a step of using a silicon diode to sense the temperature.

34. The method as claimed in claim 27 further comprising a step of oscillating the driver circuit at frequency that permits exclusive use of solid-state non-polarized capacitors in the converter.

* * * * *